US007466269B2

(12) United States Patent
Haziza

(10) Patent No.: US 7,466,269 B2
(45) Date of Patent: Dec. 16, 2008

(54) VARIABLE DIELECTRIC CONSTANT-BASED ANTENNA AND ARRAY

(75) Inventor: Dedi David Haziza, Cupertino, CA (US)

(73) Assignee: Wavebender, Inc., Santa Clara, CA (US)

( * ) Notice: Subject to any disclaimer, the term of this patent is extended or adjusted under 35 U.S.C. 154(b) by 0 days.

(21) Appl. No.: 11/747,148

(22) Filed: May 10, 2007

(65) Prior Publication Data

US 2008/0036664 A1 Feb. 14, 2008

Related U.S. Application Data

(63) Continuation of application No. 11/695,913, filed on Apr. 3, 2007.

(60) Provisional application No. 60/890,456, filed on Feb. 16, 2007, provisional application No. 60/859,799, filed on Nov. 17, 2006, provisional application No. 60/859,667, filed on Nov. 17, 2006, provisional application No. 60/808,187, filed on May 24, 2006.

(51) Int. Cl.
*H01Q 1/38* (2006.01)

(52) U.S. Cl. ..... 343/700 MS; 343/702

(58) Field of Classification Search ..... 343/700 MS, 343/702; 29/600, 601
See application file for complete search history.

(56) References Cited

U.S. PATENT DOCUMENTS 3,942,180 A 3/1976 Rannou et al.
5,579,019 A 11/1996 Uematsu et al.
5,793,334 A 8/1998 Anderson et al.
2003/0038745 A1 2/2003 Lalezari et al.
2003/0122724 A1 7/2003 Shelley et al.
2004/0246069 A1 12/2004 Yoneda et al.
2005/0146478 A1 7/2005 Wang et al.
2005/0174290 A1 * 8/2005 Huang ..... 343/700 MS
2006/0055605 A1 3/2006 Peled et al.

OTHER PUBLICATIONS

International Search Report for PCT Application No. PCT/US07/24047 dated May 2, 2008.
International Search Report for PCT Application No. PCT/US07/12004 dated Jul. 7, 2008.
International Search Report for PCT Application No. PCT/US07/24027 dated May 14, 2008.
International Search Report for PCT Application No. PCT/US07/24028 dated May 20, 2008.
International Search Report for PCT Application No. PCT/US07/24029 dated May 14, 2008.

* cited by examiner

*Primary Examiner*—Hoang V Nguyen
(74) *Attorney, Agent, or Firm*—Nixon Peabody LLP; Joseph Bach, Esq.

(57) ABSTRACT

An antenna and antenna array are provided. A radiating elements and corresponding feed lines are provided over a variable dielectric constant material sandwiched between two panels. The sandwich may be in the form of an LCD. The dielectric constant in a selected area under the conductive line can be varied to control the phase of the radiating element. The dielectric constant in a selected area under the radiating element can be varied to control the resonance frequency of the radiating element. The dielectric constant in a selected area under the conductive line can be varied to also control the polarization of the radiating element.

20 Claims, 2 Drawing Sheets

VARIABLE DIELECTRIC CONSTANT-BASED ANTENNA AND ARRAY

CROSS-REFERENCE TO RELATED APPLICATIONS

This Application is a continuation of and claims priority from U.S. application Ser. No. 60/808,187, filed May 24, 2006; U.S. application Ser. No. 60/859,667, filed Nov. 17, 2006; U.S. application Ser. No. 60/859,799, filed Nov. 17, 2006; U.S. application Ser. No. 60/890,456, filed Feb. 16, 2007; and U.S. application Ser. No. 11/695,913, filed Apr. 3, 2007, the disclosures of all of which are incorporated herein by reference in their entirety.

BACKGROUND

1. Field of the Invention

The general field of the invention relates to a unique electromagnetic antenna which can be used for radiating and non-radiating electromagnetic devices. Embodiments of the invention relate generally to antenna structures and, more particularly, to antenna structure having a radiating element structured on LCD, and to antenna having an array of such radiating elements.

2. Related Arts

Various antennas are known in the art for receiving and transmitting electro-magnetic radiation. Physically, an antenna consists of a radiating element made of conductors that generate radiating electromagnetic field in response to an applied electric and the associated magnetic field. The process is bidirectional, i.e., when placed in an electromagnetic field, the field will induce an alternating magnetic fields in the antenna and electric field would be generated between the antenna's terminals. The feed or transmission lines or network, conveys the signal between the antenna and the transceiver. The feed network may be different type of transmission lines, bends, power splitters, filters and may also include antenna coupling networks and/or waveguides. An antenna array refers to two or more antennas coupled to a common source or load so as to produce a directional radiation pattern. The spatial relationship between individual antennas contributes to the directivity of the antenna. An antenna array in general is basically applying the sampling theorem in a spatial world, thus any aperture antenna such as horn antennas, reflectors or any other shape of open aperture, can be designed to produce similar radiation patterns and gain, using an array which consists of a certain type of element, which is a basic antenna element, and arranged in a grid, rectangular or other with predefined spacing between the elements.

While the antenna disclosed herein is generic and may be applicable to a multitude of applications, one particular application that can immensely benefit from the subject antenna is the reception of satellite television (Direct Broadcast Satellite, or "DBS"), both in a stationary and mobile setting. Fixed DBS, reception is accomplished with a directional antenna aimed at a geostationary satellite. In mobile DBS, the antenna is situated on a moving vehicle (earth bound, marine, or airborne). In such a situation, as the vehicle moves, the antenna needs to be continuously aimed at the satellite. Various mechanisms are used to cause the antenna to track the satellite during motion, such as a motorized mechanism and/or use of phase-shift antenna arrays. Further general information about mobile DBS can be found in, e.g., U.S. Pat. No. 6,529,706, which is incorporated herein by reference.

One known two-dimensional beam steering antenna uses a phased array design, in which each element of the array has a phase shifter and amplifier connected thereto. A typical array design for planar arrays uses either micro-strip technology or slotted waveguide technology (see, e.g., U.S. Pat. No. 5,579,019). With micro-strip technology, antenna efficiency greatly diminishes as the size of the antenna increases. With slotted waveguide technology, the systems incorporate complex components and bends, and very narrow slots, the dimensions and geometry of all of which have to be tightly controlled during the manufacturing process. The phase shifters and amplifiers are used to provide two-dimensional, hemispherical coverage. However, phase shifters are costly and, particularly if the phased array incorporates many elements, the overall antenna cost can be quite high. Also, phase shifters require separate, complex control circuitry, which translates into unreasonable cost and system complexity.

A technology similar to DBS, called GBS (Global Broadcast Service) uses commercial-off-the-shelf technologies to provide wideband data and real-time video via satellite to a diverse user community associated with the US Government. The GBS system developed by the Space Technology Branch of Communication-Electronics Command's Space and Terrestrial Communications Directorate uses a slotted waveguide antenna with a mechanized tracking system. While that antenna is said to have a low profile—extending to a height of "only" 14 inches without the radome (radar dome)—its size may be acceptable for military applications, but not acceptable for consumer applications, e.g., for private automobiles. For consumer applications the antenna should be of such a low profile as not to degrade the aesthetic appearance of the vehicle and not to significantly increase its drag coefficient.

Current mobile systems are expensive and complex. In practical consumer products, size and cost are major factors, and providing a substantial reduction of size and cost is difficult. In addition to the cost, the phase shifters of known systems inherently add loss to the respective systems (e.g., 3 dB losses or more), thus requiring a substantial increase in antenna size in order to compensate for the loss. In a particular case, such as a DBS antenna system, the size might reach 4 feet by 4 feet, which is impractical for consumer applications.

As can be understood from the above discussion, in order to develop a mobile DBS or GBS system for consumers, at least the following issues must be addressed: increased efficiency of signal collection, reduction in size, and reduction in price. Current antenna systems are relatively too large for commercial use, have problems with collection efficiency, and are priced in the thousands, or even tens of thousands of dollars, thereby being way beyond the reach of the average consumer. In general, the efficiency discussed herein refers to the antenna's efficiency of collecting the radio-frequency signal the antenna receives into an electrical signal. This issue is generic to any antenna system, and the solutions provided herein address this issue for any antenna system used for any application, whether stationary or mobile.

There are several types of microstrip antennas (also known as a printed antennas) the most common of which is the microstrip patch antenna or patch antenna. A patch antenna is a narrowband, wide-beam antenna fabricated by etching the antenna element pattern in metal trace bonded to an insulating substrate. Some patch antennas eschew a substrate and suspend a metal patch in air above a ground plane using dielectric spacers; the resulting structure is less robust but provides better bandwidth. Because such antennas have a very low profile, are mechanically rugged and can be conformable, they are often mounted on the exterior of aircraft and spacecraft, or are incorporated into mobile radio communications devices.

An advantage inherent to patch antennas is the ability to have polarization diversity. Patch antennas can easily be designed to have Vertical, Horizontal, Right Hand Circular (RHCP) or Left Hand Circular (LHCP) Polarizations, using multiple feed points, or a single feedpoint with asymmetric patch structures. This unique property allows patch antennas to be used in many areas types of communications links that may have varied requirements.

FIG. 1 illustrates an example of a microstrip antenna of the prior art. As shown in FIG. 1, four conductive patches 105-120 are provided over dielectric 130. A base "common" ground conductor is provided below the dielectric 130, but is not shown in FIG. 1. Conductive lines 105'-120' provide electrical connection to main line 140, which is connected to a central feed line 145.

A liquid crystal display (commonly abbreviated LCD) is a thin, flat display device made up of any number of color or monochrome pixels arrayed in front of a light source or reflector. Each pixel of an LCD consists of a layer of perpendicular molecules aligned between two transparent electrodes, and two polarizing filters, the axes of polarity of which are perpendicular to each other. With no liquid crystal between the polarizing filters, light passing through one filter would be blocked by the electrodes. The surfaces of the electrodes that are in contact with the liquid crystal material are treated so as to align the liquid crystal molecules in a particular direction. This treatment typically consists of a thin polymer layer that is unidirectionally rubbed using a cloth (the direction of the liquid crystal alignment is defined by the direction of rubbing).

Before applying an electric field, the orientation of the liquid crystal molecules is determined by the alignment at the surfaces. In a twisted nematic device (the most common liquid crystal device), the surface alignment directions at the two electrodes are perpendicular, and so the molecules arrange themselves in a helical structure, or twist. Because the liquid crystal material is birefringent, light passing through one polarizing filter is rotated by the liquid crystal helix as it passes through the liquid crystal layer, allowing it to pass through the second polarized filter. Half of the light is absorbed by the first polarizing filter, but otherwise the entire assembly is transparent.

When a voltage is applied across the electrodes, a torque acts to align the liquid crystal molecules parallel to the electric field, distorting the helical structure (this is resisted by elastic forces since the molecules are constrained at the surfaces). This reduces the rotation of the polarization of the incident light, and the device appears gray. If the applied voltage is large enough, the liquid crystal molecules are completely untwisted and the polarization of the incident light is not rotated at all as it passes through the liquid crystal layer. This light will then be polarized perpendicular to the second filter, and thus be completely blocked and the pixel will appear black. By controlling the voltage applied across the liquid crystal layer in each pixel, light can be allowed to pass through in varying amounts, correspondingly illuminating the pixel.

FIG. 2 illustrates a cross-section of an LCD of the prior art. As shown in FIG. 2, the LCD 200 comprises a back panel 205 which may be glass, a front panel 210 which is also generally made of glass, a liquide crystal 215 positioned between the two panels, a back electrode 220, which may be indium/titanium/oxide (ITO), aluminum, etc, and front electrodes 225, which are coupled to potential 230 and are generally made of ITO. The potential 230 may be applied individually to each electrode 225. As potential is applied to an electrode 225, the liquide crystal below it changes its orientation and, thereby changes the local dielectric constant between the powered electrode and the section of the rear electrode corresponding to the area of the front electrode.

SUMMARY

The following summary of the invention is provided in order to provide a basic understanding of some aspects and features of the invention. This summary is not an extensive overview of the invention, and as such it is not intended to particularly identify key or critical elements of the invention, or to delineate the scope of the invention. Its sole purpose is to present some concepts of the invention in a simplified form as a prelude to the more detailed description that is presented below.

According to aspects of the invention, a one or two-dimensional electronic scanning antenna is provided, which does not require any phase shifters or low noise amplifiers (LNA's).

According to aspects of the invention, there is provided a novel scanning antenna array having radiating elements which provides high conversion efficiency, while being small, simple, and inexpensive to manufacture.

According to aspects of the invention, there is provided a novel scanning antenna array having an array of radiating elements provided over an LCD structure.

According to aspects of the invention, a novel antenna is provided comprising: a back panel having a conductive layer provided on a surface thereof; a top panel; a variable dielectric constant material sandwiched between the back panel and the top panel; at least one radiating element provided over the top panel; and, at least one conductive line provided over the top panel and coupled to the at least one radiating element. The variable dielectric constant material may comprise liquid crystal. The back panel and the top panel may comprise an insulating material. The antenna may further comprise at least one electrode provided on the top panel; an insulating layer provided over the electrode; and, wherein the at least one radiating element and the at least one conductive line are provided over the insulating layer. The variable dielectric constant material may be provided in defined zones. The common electrode, back panel, liquid crystal, top panel and electrode may comprise a liquid crystal display. The antenna may further comprise a power source coupled to the at least one electrode.

According to further aspects of the invention, a scanning antenna array is provided, comprising: a back panel; a top panel; a plurality of zones of variable dielectric constant material sandwiched between the back panel and the top panel; a plurality of radiating elements provided over the top panel; a plurality of conductive line provided over the top panel and each coupled to a respective one of the plurality of radiating elements, each of the conductive lines traversing over at least one of the zones. Each of the zones may further comprise an electrode. The antenna may further comprise an insulating layer provided over the electrodes, and the radiating elements and the conductive lines may be provided over the insulating layer. The dielectric constant of at least one of the zones may be made to differ from the dielectric constant of at least one other zone. Each of the electrodes may be coupled to a power source.

According to yet further aspects of the invention, a method of manufacturing an antenna is provided, comprising: providing a back panel; providing a top panel; sandwiching a variable dielectric constant material between the back panel and the top panel; providing at least one radiating element over the top panel; providing at least one conductive line over the top panel and coupling the conductive line to the radiating element. The step of sandwiching may comprise sandwiching the variable dielectric constant in a plurality of zones. The method may further comprise providing a plurality of electrode, each electrode provided over a respective one of the zones; and providing a dielectric layer between the electrodes and the at least one radiating element and the conductive line. The step of sandwiching a variable dielectric constant material may comprise sandwiching a liquid crystal in a plurality of zones. The steps of providing a back panel, providing a top panel, and sandwiching a variable dielectric constant material between the back panel and the top panel, may comprise providing a liquid crystal display.

According to other aspects of the invention, an antenna is manufactured by the process comprising: providing a back panel; providing a top panel; sandwiching a variable dielectric constant material between the back panel and the top panel; providing at least one radiating element over the top panel; providing at least one conductive line over the top panel and coupling the conductive line to the radiating element. The process of manufacture may further comprise: sandwiching the variable dielectric constant material in a plurality of zones, wherein at least one zone is provided under each of the at least one conductive line. The process of manufacture may further comprise: providing a plurality of electrode, each electrode provided over a respective one of the zones; providing a dielectric layer between the electrodes and the at least one radiating element and the at least one conductive line.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

FIG. 3A depicts an example of a scanning antenna according to an embodiment of the invention, while

DETAILED DESCRIPTION

Various embodiments of the invention are generally directed to a structure of radiating elements and their feed lines provided over an LCD structure, and a scanning antenna array and systems incorporating such a structure. In the context of the description of the various embodiments, the LCD structure used for the inventive antenna need not include a lighting source. The various embodiments described herein may be used, for example, in connection with stationary and/or mobile platforms. Of course, the various antennas and techniques described herein may have other applications not specifically mentioned herein. Mobile applications may include, for example, mobile DBS or VSAT integrated into land, sea, or airborne vehicles. The various techniques may also be used for two-way communication and/or other receive-only applications.

Figure 1:
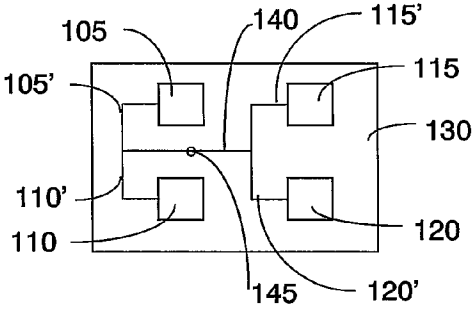
FIG. 1 illustrates an example of a microstrip antenna of the prior art.
Figure 3A:
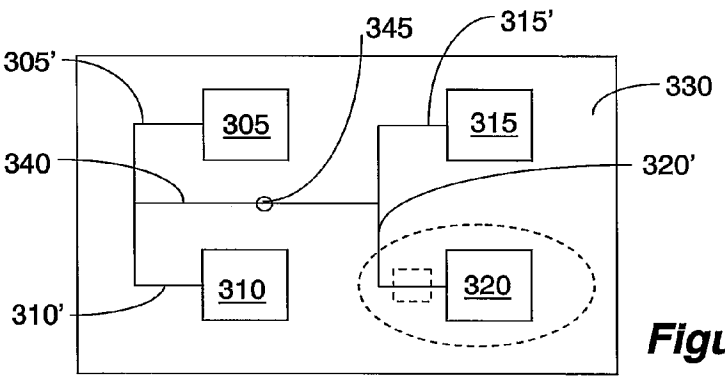
Figure 3B:
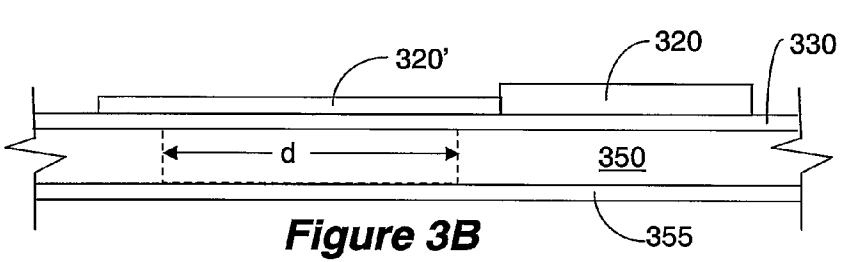
FIG. 3B depicts a cross section of an enlarged area shown by the broken-line circle of FIG. 3A.
Figure 2:
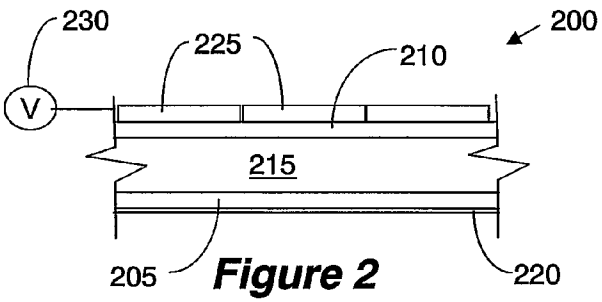
FIG. 2 illustrates a cross-section of an LCD of the prior art.

FIG. 3A depicts an example of a scanning antenna according to an embodiment of the invention, while FIG. 3B depicts a cross section of an enlarged area shown by the broken-line oval of FIG. 3A. As shown in FIG. 3A, a microstrip array, comprising elements 305-320 is provided over dielectric 330. Lines 305'-320' lead to the main line 340, which is coupled to the source 345. As shown in FIG. 3B, the dielectric 330 is provided over a variable dielectric material 350, such as liquid crystal, which is sandwiched by a back panel 355, which may be glass. Using this configuration, the microstrip array can be used as a scanning antenna array. That is, by separately changing the dielectric constant of the material 350 under each of the feed line 305'-320', as shown by the broken-line rectangle, a phase delay can be introduced between the radiation of the array elements 305-320.

More specifically, the phase, $\Phi$, can be expressed as:

$$\Phi=2\pi d/\lambda_g$$

wherein $\lambda_g$ is the wavelength in the matter and d is the length of the propagation line. On the other hand, $\lambda_g$ can be expressed as:

$$\lambda_g=\lambda_0/\sqrt{\epsilon_{eff}}$$

wherein $\lambda_0$ is the wavelength in air, $\epsilon_{eff}$ is a function of $\epsilon_r$, line width, and other physical parameters of the microstrip line, and $\epsilon_r$ is the dielectric constant of the propagation material. Then the phase can be expressed as:

$$\Phi=2\pi d\sqrt{\epsilon_r}/\lambda_0$$

Therefore, by separately controlling the dielectric constant of a section of the variable dielectric material 350 under each of the conductive line 320, the phase of each radiating element can be changed. Also, the phase can also be controlled by the length, d, of the section of the variable dielectric material 350 that is controlled.

Figure 3C:
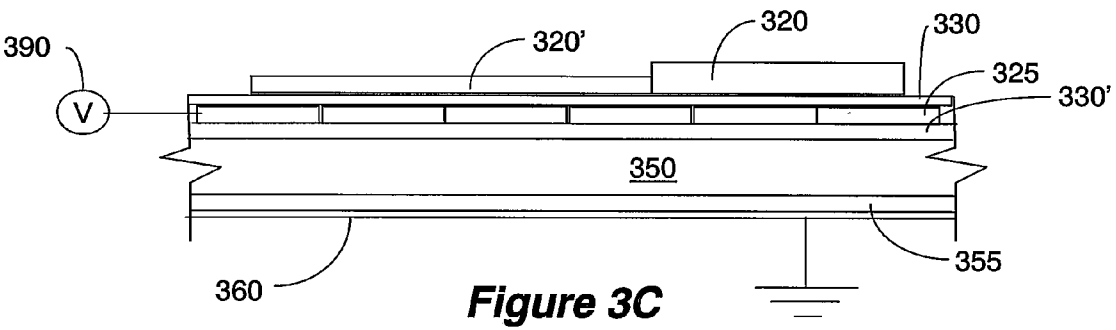
FIG. 3C illustrate a cross-section of an embodiment wherein the dielectric constant is controlled using an LCD.

FIG. 3C illustrate a cross-section of an embodiment wherein the dielectric constant is controlled using an LCD. In FIG. 3C, radiating element 320 and conductive line 302' are provided over insulating layer 330, which may be a glass panel. The insulating layer 330 is provided over an LCD comprising transparent electrodes 325, upper dielectric plate 330', liquid crystal 350, lower dielectric plate 355, and lower electrode 360. The liquid crystal may be provided in zones, as illustrated by the broken lines, and the zones may correspond to the electrodes 325. The lower electrode 360 is coupled to common potential, e.g., ground. The transparent electrodes 325 can be individually coupled to a potential 390. When the potential on any of the transparent electrodes 325 changes, the dielectric constant of the liquid crystal below it changes, thereby inducing a phase change in conductive line 320'. The phase change can be controlled by choosing the amount of voltage applied to the transparent electrode 325, i.e., controlling $\epsilon_r$, and also by controlling the number of electrodes the voltage is applied to, i.e., controlling d.

To illustrate, the following calculations are made to find the relationship enabling a phase shift of $2\pi$. When the conductive line is partially over a partially or non-biased electrode, so that the effective dielectric constant is $\epsilon_1$, and partially over a biased electrode creating dielectric constant $\epsilon_2$, the following results:

$$2\pi d\sqrt{\epsilon_1}/\lambda_0-2\pi d/\epsilon_2/\lambda_0=2\pi$$

this simplifies to:

$$\sqrt{\epsilon_1}-\sqrt{\epsilon_2}=\lambda_0/d$$

Therefore, by controlling the amount of bias, the length of the biased material, or both, one can achieve any phase shift necessary. Since in a commercial LCD the number of pixels biased and the amount of bias can be controlled independently, one may easily construct a scanning array according to this invention and easily control both $\epsilon_r$ and d.

It should be noted that the invention is not limited to the use of an LCD. That is, any material that exhibits a controllable variable dielectric constant can be used. For example, any ferroelectric material may be used instead of the liquid crystal. The embodiment shown here uses LCD, as the LCD technology is mature and readily available, which makes the invention very attractive and easy to implement.

Another feature of the invention is variable frequency scanning array. That is, as shown in the embodiments of FIG. 3A-3C, the entire area under the array has a controllable variable dielectric constant. By changing the dielectric constant under the conductive lines, one obtain phase shift, which provides the scanning of the array. On the other hand, one can also change the dielectric constant under each antenna patch. By changing the dielectric constant under the antenna patch, the resonant frequency of the patch changes. If one uses an LCD or similar arrangement, one would be able to control the amount of change of the dielectric constant under the patch by selecting the appropriate potential applied to the electrodes under the patch, thereby controlling the variability of the operating frequency of the patch. Similarly, one may also control the size of the area under the patch that is being biased, to thereby control the resonance frequency of the array to provide a frequency tunable antenna or array.

Figure 4:
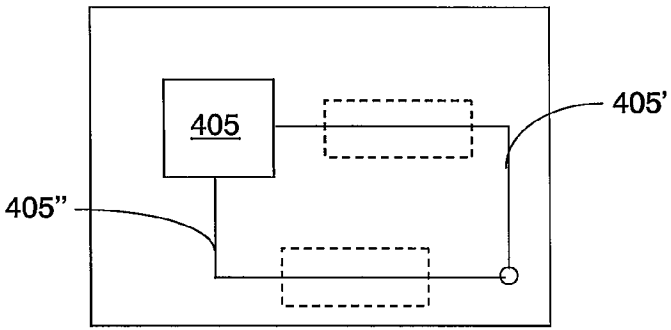
FIG. 4 illustrates a single patch microstrip antenna with dual feed arranged to provide dual circular polarization.

Yet another feature of the inventive antenna is the simplicity by which circular polarization and dual circular polarization can be implemented. FIG. 4 illustrates a single patch microstrip antenna 405 formed over a variable dielectric constant sandwich as explained above, such as, e.g., an LCD. The patch is fed from two sides by two conductor lines 405' and 405". An area under each of the conductor lines, illustrated by the broken-line rectangles, may be controlled to vary the dielectric constant so as to cause a 90° phase shift. By selecting which area is phase shifted, the patch can be left-hand or right-hand circularly polarized. Of course, since the dielectric constant may be changed at will, the selection of RHCP or LHCP can be changed at any time. Notably, the LHCP and RHCP can be accomplished while feeding from a single point. This is an advantage over the prior art wherein for such a feature a hybrid feed must be provided and wherein the feeding point must be changed in order to change between LHCP and RHCP. Here, on the other hand, the feed is fixed and is provided from a single point, thereby eliminating the complexity associated with a hybrid feed.

The inventive scanning antenna array can be made in various radiating and feeding configurations to provide various scanning characteristics, various frequency tuning, and various polarizations, to fit many applications. To illustrate, the following are examples of corporate and serial feeding utilizing the inventive features of the invention.

Figure 5:
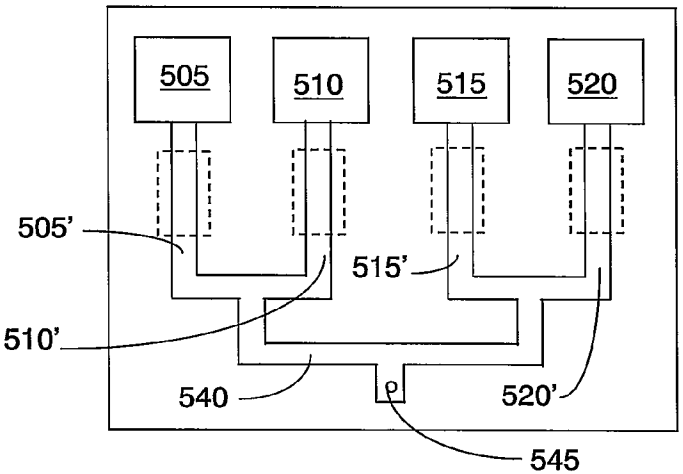
FIG. 5 depicts a scanning array using corporate feed according to an embodiment of the invention.

FIG. 5 depicts a scanning array using corporate feed according to an embodiment of the invention. In FIG. 5, four antenna patches 505-520 are provided over a variable dielectric sandwich, such as an LCD. Each patch has an associated conductive line 505'-520' which traverses an area of controllable variable dielectric constant, indicated by a respective broken-line rectangle. All of the associated conductive lines 505'-520' are coupled to a main feed line 540, which is coupled to the feed point 545. As can be understood by those skilled in the art, by controllably varying the dielectric constant under each conductive line 505'-520', the phase at each patch 505-520 may be varied, so as to generate a scanning array, in this particular case, a linear scanning array. However, this example can be easily generalized to any configuration with any number of patches to generate linear or 2-dimensional scanning array.

Figure 6:
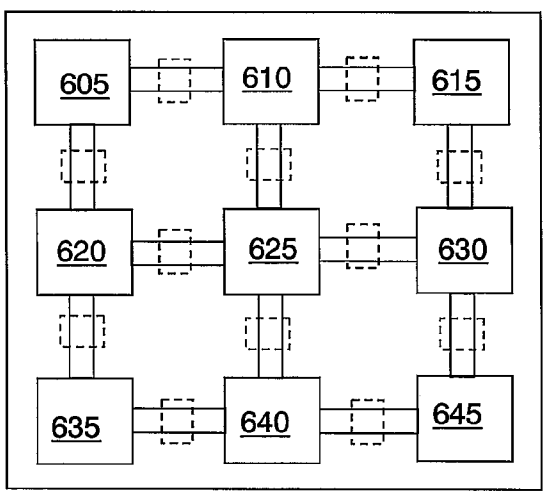
FIG. 6 illustrates a scanning antenna array with serial feed according to an embodiment of the invention.

FIG. 6 illustrates a scanning antenna array with serial feed according to an embodiment of the invention. In the example of FIG. 6, nine antenna patches 605-645 are used in a 2-dimensional array configuration. All the patches 605-645 are coupled together via conductive lines, wherein each conductive line traverses an area of controllably variable dielectric constant, illustrated by the broken-line rectangles. In this manner the phase for each patch can be varied controllably, so as to provide a 2-dimensional scanning array. As with the example of FIG. 5, this concept can be generalized to any other configuration with any number of patches.

Finally, it should be understood that processes and techniques described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein. The present invention has been described in relation to particular examples, which are intended in all respects to be illustrative rather than restrictive. Those skilled in the art will appreciate that many different combinations of hardware, software, and firmware will be suitable for practicing the present invention. For example, the described software may be implemented in a wide variety of programming or scripting languages, such as Assembler, C/C++, per, shell, PHP, Java, HFSS, CST, EEKO, etc.

The present invention has been described in relation to particular examples, which are intended in all respects to be illustrative rather than restrictive. Those skilled in the art will appreciate that many different combinations of hardware, software, and firmware will be suitable for practicing the present invention. Moreover, other implementations of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. An antenna comprising:

a back panel having a conductive layer provided on a surface thereof;

a top panel;

a variable dielectric constant material sandwiched between the back panel and the top panel;

at least one radiating element provided over the top panel; and, at least one conductive line provided over the top panel and coupled to the at least one radiating element.

2. The antenna of claim 1, wherein the variable dielectric constant material comprises liquid crystal.

3. The antenna of claim 2, wherein the back panel and the top panel comprise an insulating material.

4. The antenna of claim 3, further comprising:

at least one electrode provided on the top panel;

an insulating layer provided over the electrode; and, wherein the at least one radiating element and the at least one conductive line are provided over the insulating layer.

5. The antenna of claim 4, wherein the variable dielectric constant material is provided in defined zones.

6. The antenna of claim 5, wherein the common electrode, back panel, liquid crystal, top panel and electrode comprise a liquid crystal display.

7. The antenna of claim 4, further comprising a power source coupled to the at least one electrode.

8. A scanning antenna array, comprising:

a back panel;

a top panel;

a plurality of zones of variable dielectric constant material sandwiched between the back panel and the top panel;

a plurality of radiating elements provided over the top panel;

a plurality of conductive line provided over the top panel and each coupled to a respective one of the plurality of radiating elements, each of the conductive lines traversing over at least one of the zones.

9. The antenna of claim 8, wherein each of the zones further comprises an electrode.

10. The antenna of claim 9, further comprising an insulating layer provided over the electrodes, and wherein the radiating elements and the conductive lines are provided over the insulating layer.

11. The antenna of claim 9, wherein each of the electrodes is coupled to a power source.

12. The antenna of claim 8, wherein the dielectric constant of at least one of the zones is made to differ from the dielectric constant of at least one other zone.

13. A method of manufacturing an antenna, comprising:

providing a back panel;

fabricating a conductive layer on bottom surface of the back panel;

providing a top panel;

sandwiching a variable dielectric constant material between the back panel and the top panel;

providing at least one radiating element over the top panel;

providing at least one conductive line over the top panel and coupling the conductive line to the radiating element.

14. The method of manufacturing antenna of claim 13, wherein the step of sandwiching comprises sandwiching the variable dielectric constant in a plurality of zones.

15. The method of claim 14, further comprising:

providing a plurality of electrode, each electrode provided over a respective one of the zones;

providing a dielectric layer between the electrodes and the at least one radiating element and the conductive line.

16. The method of claim 13, wherein the step of sandwiching a variable dielectric constant material comprises sandwiching a liquid crystal in a plurality of zones.

17. The method of claim 13, wherein the steps of providing a back panel, providing a top panel, and sandwiching a variable dielectric constant material between the back panel and the top panel, comprises providing a liquid crystal display.

18. An antenna manufactured by the process comprising:

providing a back panel;

fabricating a conductive layer on bottom surface of the back panel;

providing a top panel;

sandwiching a variable dielectric constant material between the back panel and the top panel;

providing at least one radiating element over the top panel;

providing at least one conductive line over the top panel and coupling the conductive line to the radiating element.

19. The antenna of claim 18, wherein the process of manufacture further comprises:

sandwiching the variable dielectric constant material in a plurality of zones, wherein at least one zone is provided under each of the at least one conductive line.

20. The antenna of claim 19, wherein the process of manufacture further comprises:

providing a plurality of electrode, each electrode provided over a respective one of the zones;

providing a dielectric layer between the electrodes and the at least one radiating element and the at least one conductive line.

* * * * *